United States Patent [19]

Remner et al.

[11] 4,022,047

[45] May 10, 1977

[54] HOSE REEL FOR PIERCER AND REELER OUTLET TABLES

[75] Inventors: Robert A. Remner, Sewickley; Donald G. Ries, Ellwood City, both of Pa.

[73] Assignee: Aetna-Standard Engineering Company, Ellwood City, Pa.

[22] Filed: May 4, 1976

[21] Appl. No.: 682,918

[52] U.S. Cl. ..... 72/201; 72/209; 72/97

[51] Int. Cl.[2] ..... B21B 17/10; B21B 25/04; B21B 19/04

[58] Field of Search ..... 72/96, 97, 98, 200, 72/201, 202, 208, 209

[56] References Cited

UNITED STATES PATENTS

| | | | |
|---|---|---|---|
| 1,732,404 | 10/1929 | Idel | 72/97 |
| 2,167,424 | 7/1939 | Novack | 72/209 |
| 3,392,565 | 7/1966 | Rodder | 72/201 |
| 3,747,385 | 7/1973 | Meurer et al. | 72/97 |

FOREIGN PATENTS OR APPLICATIONS

| | | | |
|---|---|---|---|
| 1,948,082 | 4/1971 | Germany | 72/201 |
| 150,468 | 2/1961 | U.S.S.R. | 72/201 |

*Primary Examiner*—C.W. Lanham
*Assistant Examiner*—E. M. Combs
*Attorney, Agent, or Firm*—Mandeville and Schweitzer

[57] ABSTRACT

The disclosure generally relates to a positive drive hose reel apparatus for a cooling system mounted on the linearly movable thrust block of a piercing or reeling mill. The thrust block means is adapted to move along a path between a working position and a retracted position and includes a rotatably mounted hose reel apparatus to support a flexible hose. The hose interconnects a remote water supply with the cooling system of the thrust block. A drive cable extends between and is secured at points adjacent the working position and retracted position and is partially wrapped around the hose reel apparatus, whereby the linear movement of the thrust block will impart positive rotational movement to the hose reel apparatus and thereby coil and uncoil the hose, as needed as the thrust block moves at high speed back and forth along the path.

7 Claims, 5 Drawing Figures

HOSE REEL FOR PIERCER AND REELER OUTLET TABLES

BACKGROUND AND SUMMARY OF THE INVENTION

This invention relates to the manufacture of seamless tubing and more particularly to a positive drive hose reel apparatus for a water cooling system mounted on a linearly movable thrust block for piercing and reeling mills.

In the manufacture of seamless tubing, one of the initial operations is a piercing of a heated cylindrical solid metal billet by a pair of angularly disposed driven mill rolls which force the billet over a piercing point on the end of a mandrel bar. The mandrel bar extends away from the mill rolls in the direction of longitudinal movement of the billet over the piercing point, for a distance that is at least as great as the length of the longest tube to be formed on the mill. The rear end of the mandrel bar is supported by a movable carriage or thrust block which is adapted to be retracted, after a pierced billet has passed through the mill rolls, to withdraw the bar from the tube so that the tube can be removed from the outlet table on which it is received after the piercing operation. The thrust block is thereafter advanced, to return the bar to a working position with the piercing point adjacent the mill rolls.

To avoid overheating of the mandrel bar and piercing point, the thrust block is provided with an arrangement for supplying cooling water to the piercing point during the tube forming operation. Typically, the cooling water is supplied to the movable thrust block by an elongated flexible hose interconnecting the thrust block with a water supply. During each operating cycle of the mill, the thrust block executes a substantial linear movement in order first to bring the piercing point to its working position and thereafter to withdraw the mandrel bar from the formed tube. The total distance traversed may be in the order of 24 meters or so. Therefore, it is necessary to provide means to pay out the flexible hose when the thrust block is advancing the piercing point to its working position, and to take up the excess length of hose during the retracting motion of the thrust block, all while the thrust block is moving at high speed.

The prior art has heretofore proposed several means for feeding and taking up the flexible hose. For example, the hose feed and take up function has been accomplished by a spring driven reel, carried by the thrust block. In accordance with this proposal, the flexible hose is wound on the reel. As the thrust block advances towards its working position, the reel unwinds against the action of the spring and the hose is advanced. When the thrust block retracts, the spring drive of the reel will cause it to rotate and thereby take up the excess length of hose. In another prior proposal, a festoon arrangement has been provided with the hose being suspended in intervals along a slide way positioned adjacent to the outlet table of the piercing mill. In accordance with this proposal, a suitable length of hose can slide back and forth along the slide way as the thrust block advances and retracts. Recent developments in the design of piercing and reeling mills have, however, substantially increased the speed of operation of the mills in order to derive improved efficiencies. Consequently, the thrust block will now be moved at high speeds during the stripping cycle, and neither of the above described prior hose feed arrangements is suitable for accommodating high speed thrust block movement on a practical basis.

As one of its basic objectives, the present invention provides a novel positive drive hose reel apparatus which will both pay out and recoil the flexible hose in accordance with the speed of movement of the thrust block. The positive drive arrangement disclosed herein is a simplified, yet highly effective arrangement wherein the linear movement of the thrust block will be directly translated into the positive drive for the flexible hose pay out and take up. Consequently, the arrangement of the present invention will accommodate the high operating speeds of the thrust block and insure a relatively foolproof hose feed.

In the illustrated form of the invention, a rotatable hose reel is carried by the thrust block. A suitable length of flexible hose is wound on the reel with one end thereof connected to the water cooling system of the thrust block and the other end connected to a remote water supply. A positive drive for the reel is provided by a cable, extending the full length of the path of movement of the thrust block, and connected under tension at both ends. The cable has one or more wraps around a separate cable-receiving section of the hose reel. Linear motion of the thrust block will pull on the cable causing it to rotate the hose reel in a rotational direction to either pay out the hose or take up excess hose length, depending on whether the thrust block is advancing or retracting. The rate of rotation of the reel will at all times be appropriately related to the speed of linear movement of the thrust block and the length of hose payed out or taken up will always be proper.

Pursuant to another feature of the present invention, a cable-receiving section of the hose reel is of a "stepped" configuration, to provide that the center axis of the hose will be on the same radius as the center of the cable. This will insure the proper rotational speed of the hose reel in accordance with the linear speed of the thrust block. The longitudinal dimension of the hose reel and cable-receiving section are of a sufficient length to accommodate the wound portions of the hose and cable respectively, when fully coiled, in a single layer thereby maintaining the advantage of the "stepped" configuration.

For a better understanding and appreciation of the above and other features and advantages of the present invention, reference should be made to the following detailed description of a preferred embodiment and to the accompanying drawings.

DETAILED DESCRIPTION OF A PREFERRED EMBODIMENT

Figure 1:
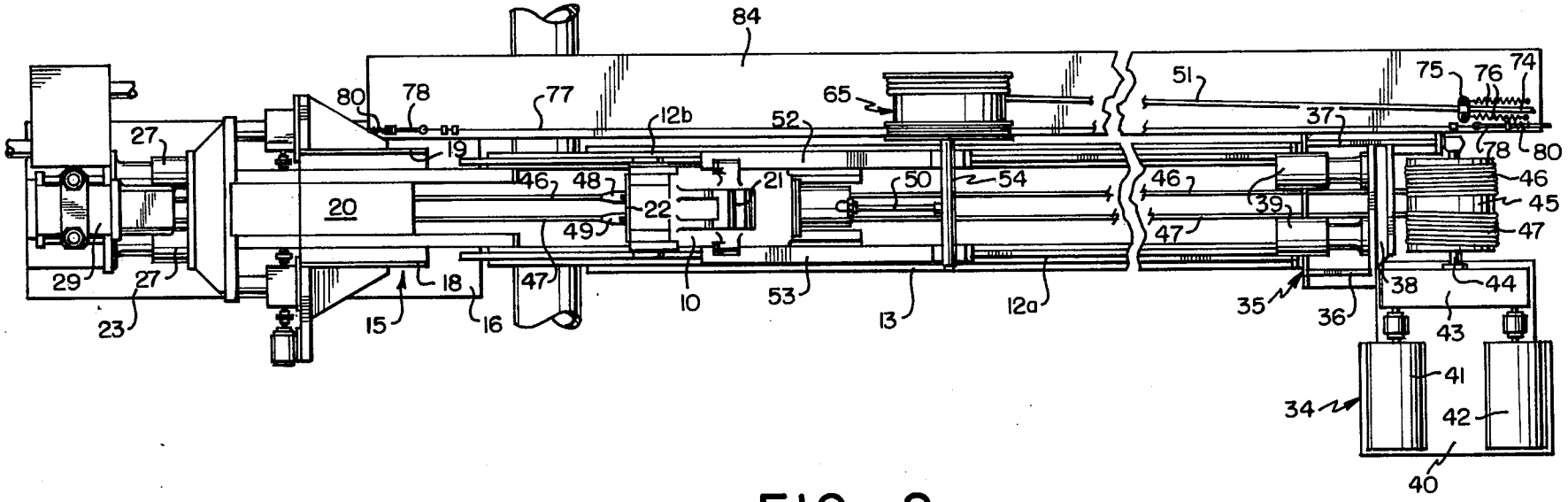
FIG. 1 is a top plan view of a general arrangement for a mandrel bar thrust block and outlet table for a piercing or reeling mill incorporating features of the present invention.
Figure 2:
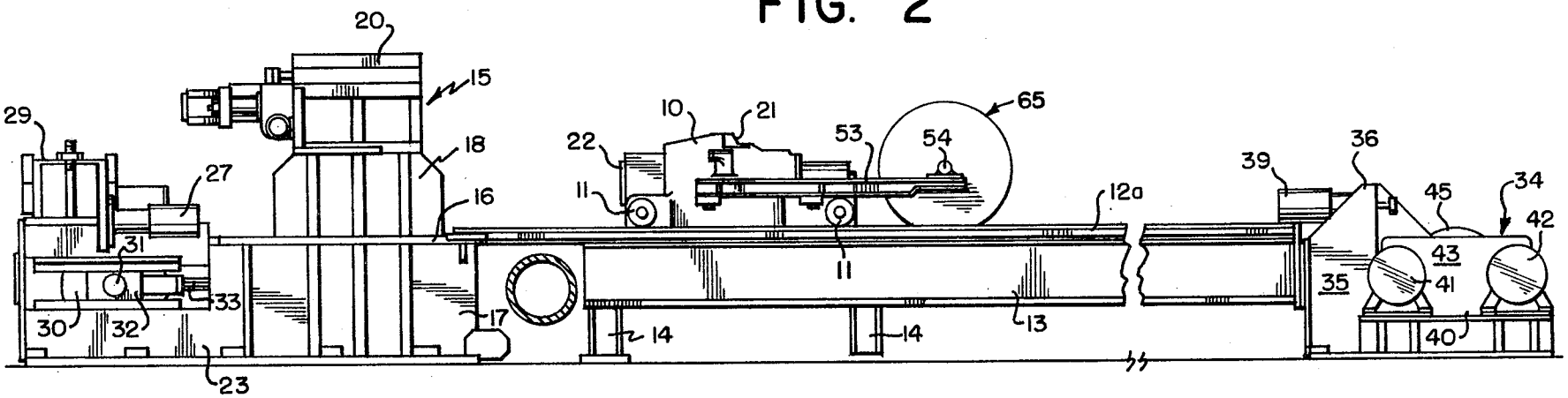
FIG. 2 is a side elevational view of the arrangement of FIG. 1.

Referring now to the drawings, and initially to FIGS. 1 and 2 thereof, there is illustrated the general arrangement for a mandrel bar thrust block in a piercing or reeling mill. A thrust block carriage 10 is provided with a set of supporting wheels 11, adapted to engage a pair of horizontal rails 12*a*, 12*b*, whereby the carriage 10 can be moved therealong. The horizontal rails 12*a*, 12*b* are mounted on a longitudinally extending support table 13 which is supported by a plurality of spaced, vertical elements 14.

A thrust block housing structure, generally designated by the reference numeral 15, is positioned adjacent the upstream or left hand end portion of the horizontal rails 12*a*, 12*b*. The rails 12*a*, 12*b*, are each connected to a platform 16 mounted on a base 17 of the housing structure 15. The thrust block carriage 10 can thus be moved along the horizontal rails 12*a*, 12*b*, and onto the platform 16. A pair of side walls 18, 19 are mounted on the platform 16 and form a support for a thrust block locking mechanism 20. When the thrust block carriage 10 is moved onto the platform 16, it will be received between the side walls 18, 19 and positioned directly beneath the locking mechanism 20. This will be defined as the working position for the thrust block carriage 10. The locking mechanism 20, includes a movable lever (not shown) which is lowered after the thrust block carriage 10 is in the working position. The top portion of the thrust block carriage 10 includes a rearwardly facing shoulder position 21 which is adapted to engage the movable lever when the thrust block carriage 10 is in the working position. In this manner, the action of the lever against the shoulder portion 21 will lock the carriage in the working position against the heavy horizontal forces of the mill.

In accordance with known principles, the thrust block carriage 10 is provided with a front bearing support or socket 22 to mount a mandrel bar (not shown). The working position is arranged so that a mounted mandrel bar will extend in the horizontal plane from the bearing support 22 of the thrust block carriage 10 towards the left terminating at the mill roll stand (not shown). The mill rolls are positioned adjacent a piercing point or reeling plug mounted on the forward end of the mandrel bar, and the billet is advanced over the piercing or reeling point in a conventional and well known manner. The horizontal compressive load developed against the mandrel bars by the billet is absorbed by the thrust block carriage and its locking lever.

Extending from the left hand side of the base 17 of the housing structure 15 is a support structure 23. A pair of shock-absorbing abutment stop members 27 are mounted on the support structure 23 to decelerate the thrust block carriage 10 at the forward limit of its traverse. A mandrel bar steadier 29 may be mounted on the structure 23 to support the mandrel bar during forward movement of the thrust block carriage.

A cable drum 30 is mounted on a shaft 31 journaled in bearings 32 which are mounted on the support structure 23. The cable drum 30 forms part of a cable drive means for the thrust block carriage 10. A tensioning mechanism 33 is provided to urge the cable drum 30 laterally to the left and thereby maintain carriage drive cables in a taut condition.

Positioned at the right hand end portion of the horizontal rails 12*a*, 12*b* is a cable drive means, designated generally by the numeral 34. A support structure 35 is mounted at the end of the main support table 13, and extends there beyond on either side in the vertical plane. The structure 35 includes a pair of side walls 36, 37 supporting a cross beam 38 therebetween. A pair of abutment stop members 39 are mounted on the cross beam 38 to act as a limit stop for the thrust block carriage 10 when it is moved to the extreme right position. This position is defined as the retracted position of the thrust block carriage 10.

A platform 40 is provided to mount two double acting drive motors 41, 42 each mechanically linked to a gear box 43. An output shaft 44 is rotatably supported, at one end by the gear box 43 and at the other end by the side wall 37. The shaft 44 is mechanically linked to the gear box 43, whereby operation of the motors 41, 42 will rotate the shaft 44. Mounted on the shaft 44 is a cable drum 45. A pair of endless cables 46, 47 are wound on and connected between the cable drums 30, 45 and connected to the thrust block carriage 10 by cable connector means 48, 49. In this manner, the thrust block carriage 10 can be driven by the cables 46, 47 along the horizontal rails 12*a*, 12*b* upon rotation of the cable drum 45 by the motors 41, 42. Thus, in accordance with the operating cycle of the piercing mill, described hereinabove, the thrust block carriage 10 can be repeatedly moved between the working position, to bring the piercing point of the mandrel bar adjacent the mill rolls, and the retracted position, to withdraw the mandrel bar from the formed tube.

As was mentioned previously, a large compressive load is applied to the piercing point of the mandrel bar by the billet. Typically, the mandrel bar includes a hollow central portion whereby cooling water can be forced to the mandrel point. In this regard, the thrust block carriage 10 includes a section of tubing 50 which extends centrally through the carriage 10 to the bearing support 22 wherein it can communicate with a hollow portion of a mounted mandrel bar.

Figure 3:
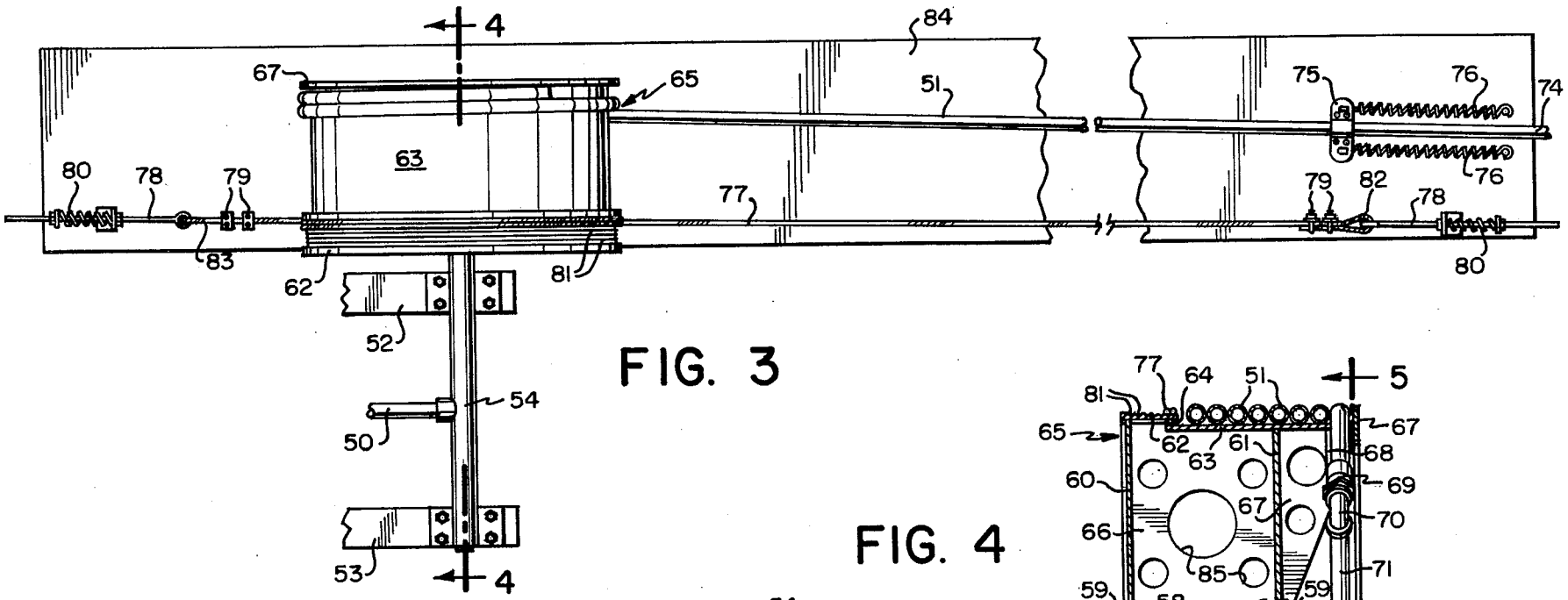
FIG. 3 is an enlarged top plan view of the positive drive hose reel arrangement of the present invention.
Figure 4:
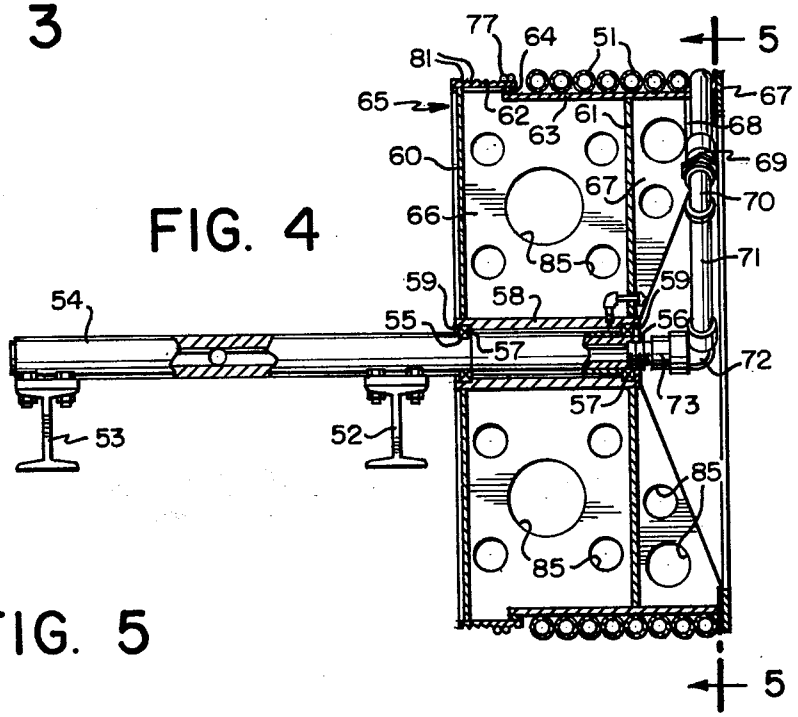
FIG. 4 is a cross sectional view of the hose reel arrangement taken generally along the line 4—4 of FIG. 3.
Figure 5:
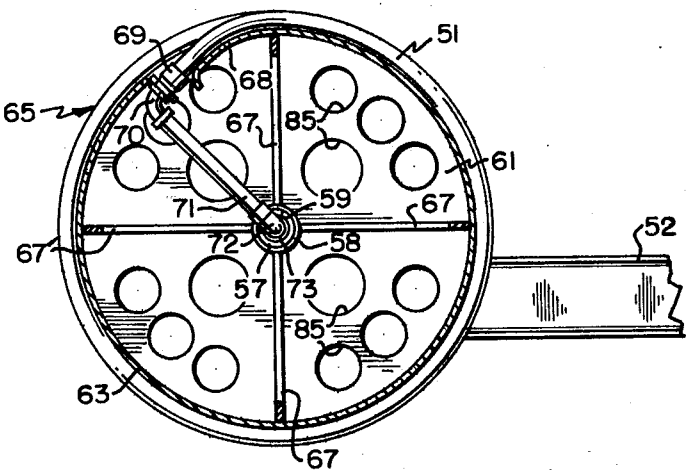
FIG. 5 is a cross sectional view of the hose reel arrangement taken generally along the line 5—5 of FIG. 4.

Referring now to FIGS. 3–5, there is illustrated a positive drive hose reel apparatus according to the present invention, whereby the tubing 50 is connected to a remote water supply (not shown) by means of a flexible hose 51. The thrust block carriage 10 is provided with a pair of spaced, rearwardly extending support members 52, 53. A bearing tube 54 is securely mounted on the support members 52, 53 and projects in a direction perpendicular to the direction of movement of the carriage 10 at one side thereof. The tubing 50 communicates with the bearing tube 54.

Recessed portions 55, 56 are formed at the projecting end of the bearing tube 54, each receiving a ball bearing element 57. To advantage, a hose reel support tube 58 is rotatably mounted on the bearing tube 54 by means of the ball bearing elements 57 which are received at end stepped portions 59 of the support tube 58. A pair of spaced, annular plates 60, 61 are received over the hose reel support tube 58 and are secured thereon, for example, by welding.

As shown in FIG. 4, the annular plate 60 is of a larger diameter than the annular plate 61. In this manner, and in accordance with the invention, two cylinder sleeves 62, 63 of different diameters, can be applied over the plates 60, 61 respectively, and interconnected by a circular metal strap 64, for example, by welding each of the cylinder sleeves 62, 63 to the strap 64. This forms a "stepped" cylindrical reel structure rotatably mounted on the tubing 54 and which will serve as a hose reel assembly, designated generally by the reference numeral 65. The cylinder sleeve 63 serves as a hose-winding portion of the hose reel while the sleeve 62 will carry a cable.

To add extra support to the hose reel 65, a plurality of internal web plates 66, 67 extend between the hose reel support 58 and cylinder sleeves 62, 63. Each of the web plates 66, 67 and annular plates 60, 61 include cutouts 85 to reduce the overall mass of the hose reel 65. A flange ring 67 is welded to the outer end of the hose-winding sleeve 63 to prevent the hose 51 from sliding off.

At a selected point on the hose-winding sleeve 63, a thin section 68 of the sleeve surface is cut out and bent downwardly into the interior of the hose reel. When the hose 51 is wound on the hose reel assembly 65 a hose connector 69, on one end thereof, will be directed into the interior of the hose reel by the section 68, and joined to an elbow 70. The elbow 70 communicates with a section of tubing 71 which extends radially to, and communicates with a second elbow 72. The end of the tubing 54 is enlarged and threaded to receive a rotary coupling 73 which is connected to the elbow 72 whereby the bearing tube 54 communicates with the hose 51.

One end portion of the hose 51 is wound around the sleeve 63 in a helical arrangement with the remote end 74 of the hose being gripped by a clamp 75 in an area adjacent the retracted position of the thrust block carriage 10. A pair of tension springs 76 engage the clamp 75 and hold the hose 51 under light tension. The end 74 is connected to a water supply (not shown). By this means, cooling water can be directed, in the usual manner, through the hose 51, rotary coupling 73, tubing 54 and tubing 50 to the central portion of the supported mandrel bar and thereby cool the piercing point.

Pursuant to the invention, the hose reel 65 will be positively driven by a cable 77 which extends between and is anchored at points adjacent the working position and retracted positions of the thrust block carriage 10. At these points, the cable 77 is looped through eye holders 78 and clamped by clamps 79. The eye holders 78 are secured by compression springs 80 whereby the cable 77 is held under tension.

In accordance with the present invention, the cable 77 is wound for several turns around the larger diameter cable-winding sleeve 62 of the hose reel assembly 65 in a helical arrangement. As reflected in FIG. 4, the exterior surface of the cylinder sleeve 62 is provided with a plurality of circumferentially extending helical grooves 81 to accommodate the wound cable 77. The cable-winding sleeve 62 is "stepped" to a slightly larger diameter than the hose-winding sleeve so that the center axis of the wound cable 77 will be on substantially the same diameter as the center axis of the wound hose 51. Each of the cylinder sleeves 62, 63 will be of sufficient length in the longitudinal direction to accommodate the fully wound cable 77 and hose 51, respectively, in a single layer, as reflected in FIG. 4. This will insure that the respective axis of the cable 77 and hose 51 are always substantially aligned at the same diameter.

In the operation of the positive drive hose reel, any movement of the thrust block carriage 10 effected by the cables 46, 47 will cause the hose reel assembly 65 to place the cable 77 in tension, on one side or the other of the hose reel. The cable tension will result in positively driven rotation of the hose reel 65 about the bearing tube 54 in substantially exact accordance with the linear speed of the thrust block carriage 10. If the thrust block carriage 10 is being driven towards the working position, the hose reel 65 will be driven in a clockwise rotation to unwind the hose 51 at the same linear rate as the reel is being advanced by the carriage 10. The portion of the cable 77 between the reel 65 and the working position will be taken up at the same rate by the advancing, rotating reel 65.

In a similar manner, when the thrust block carriage 10 is being moved towards the retracted position, the hose reel 65 will place in tension the section of the cable 77 extending between the reel 65 and the cable end 83 anchored at the working position, and thereby rotate the reel 65 in a counterclockwise direction. This will effect a re-winding of the hose 51 on the reel 65 at a rate closely related to the rearward linear movement of the thrust block carriage 10 to take up the portion of the hose 51 originally let out.

A table 84 is positioned adjacent the horizontal rails **12*a*, 12*a* to provide support for the unwound portion of the hose 51. The table surface is directly below the hose winding sleeve 63,** enabling the unwinding hose to be smoothly and progressively laid out on the table, as the carriage moves forward, and picked up from the table as the carriage retracts.

In this novel, straightforward manner, the present invention provides an improved and advantageous arrangement for interconnecting a linearly moveable thrust block carriage or the like with a remote fluid supply. The cable drive affords a highly effective means for imparting a positive drive to the hose reel construction, whereby the linear movement of the thrust block carriage will be directly and accurately translated into the rotational movement of the reel. The present invention greatly expedites the piercing and reeling mill operations by providing the above described positive drive hose reel arrangement which is capable of effectively following high speed thrust block movement.

It should be understood, of course, that the specific form of the present invention herein illustrated and described is intended to be representative only, as certain changes may be made therein without departing from the clear teachings of the disclosure. Accordingly, reference should be made to the following appended claims in determining the full scope of the invention.

We claim:

1. In a mill for the production of finite length tubing, a positive drive hose reel apparatus for a fluid cooling system, which comprises a. a thrust block carriage for supporting a mandrel bar, b. means for linearly displacing said thrust block carriage between a working position and a retracted position, c. a fluid cooling system mounted on said thrust block carriage to supply coolant to said mandrel bar, d. a cylindrical hose reel means rotatably mounted on said thrust block carriage, and including a hose-receiving section and a cable-receiving section, e. a hose element wound on said hose-receiving section and including a first end portion connected to said cooling system and a second end portion connected to a remote fluid supply means, f. a cable element extending between points adjacent said working position and said retracted position, g. means for securing said cable element at said points, and h. said cable element being partially wound on said cable-receiving section, whereby the linear displacement of said thrust block carriage will impart positive rotational movement to said hose reel means thereby paying out and taking up said hose element as the thrust block carriage moves back and forth between the working and retracted positions.

2. The positive drive hose reel apparatus of claim 1, further characterized by a. said cable-receiving section being of a larger diameter than said hose-receiving section whereby the center axis of the wound cable element will be on the same radius as the center axis of the wound hose element.

3. The positive drive hose reel apparatus of claim 2, further characterized by a. a hose reel support tube rotatably mounted on said thrust block carriage, b. first and second cylinder sleeves surrounding and supported on said hose reel support tube in a side-by-side relation to form said cable-receiving and hose-receiving sections, and c. said first cylinder sleeve being of a larger diameter than said second cylinder sleeve.

4. The positive drive hose reel apparatus of claim 2, further characterized by a. said hose element being wound on said hose-receiving section in a slightly helical configuration and said cable element being wound on said cable-receiving section in a slightly helical configuration.

5. In a mill for the production of finite length tubing, a positive drive hose reel apparatus comprising a thrust block carriage for supporting a mandrel bar and being linearly movable on a path between a working position and a retracted position, said thrust block carriage including a fluid cooling system to supply coolant to said mandrel bar, a hose reel means rotatably mounted on said thrust block carriage and a hose element wound on said hose reel means including a first end portion connected to said cooling system and a second end portion connection to a remote fluid supply means, the improvement comprising a. said hose reel means including a hose-receiving section and a cable-receiving section, b. said hose element being wound on said hose receiving section, c. a cable element extending along said path and secured at its ends, d. said cable element being partially wound on said cable receiving section whereby the linear movement of said thrust block carriage will impart positive rotational movement to said hose reel means to pay out and take up said hose element as the thrust block carriage moves back and forth along said path, and e. said cable-receiving section being of a larger diameter than said hose-receiving section, whereby the center axis of the wound cable element will be on the same radius as the center axis of the wound hose element.

6. In a mill for the production of finite length tubing a hose reel apparatus comprising a thrust block carriage for supporting a mandrel bar and being linearly movable on a path between a working position and a retracted position, said thrust block carriage including a fluid cooling system to supply coolant to said mandrel bar, a hose reel means rotatably mounted on said thrust block carriage and a hose element wound on said hose reel means including a first end portion connection to said cooling system and a second end portion connected to a remote fluid supply means, the improvement comprising, a. a fixed elongated drive member extending between and secured at points adjacent said working position and said retracted position, b. said hose reel means including a first section to receive said hose element and a second section having driving association with said elongated drive member, c. said elongated member being in operational driving engagement with said second section, whereby the linear displacement of said thrust block carriage will impart positive rotational movement to said hose reel means, and d. said second section being of a larger diameter than said first section, whereby the rotational movement of said hose reel means will be appropriately related to the speed of linear displacement of said thrust block carriage thereby paying out and taking up a length of said hose element substantially equal to the distance said thrust block carriage is displaced.

7. The positive drive hose reel apparatus of claim 6, further characterized by a. said elongated member comprising a cable and, b. said cable including a portion coiled on said second section.

* * * * *